US007717540B1

(12) United States Patent
King et al.

(10) Patent No.: US 7,717,540 B1
(45) Date of Patent: May 18, 2010

(54) CLOG DETECTION AND CLEARING METHOD FOR INK DELIVERY SYSTEM

(75) Inventors: Dale A. King, Pasco, WA (US); Mark A. Smith, Corvallis, OR (US); Melissa S. Gedraitis, Camas, WA (US); David J. Benson, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1070 days.

(21) Appl. No.: 11/397,218

(22) Filed: Apr. 4, 2006

(51) Int. Cl.
*B41J 2/175* (2006.01)
*B41J 2/165* (2006.01)

(52) U.S. Cl. ..... 347/34; 347/85

(58) Field of Classification Search ..... 347/22, 347/28, 29, 34, 84, 85
See application file for complete search history.

(56) References Cited

U.S. PATENT DOCUMENTS 4,183,029 A * 1/1980 Isayama et al. ..... 347/93
4,296,418 A * 10/1981 Yamazaki et al. ..... 347/28
4,734,718 A 3/1988 Iwagami et al.
5,980,034 A * 11/1999 Tsai et al. ..... 347/89
6,012,793 A 1/2000 Haigo
6,350,007 B1 * 2/2002 Meichle et al. ..... 347/29
6,702,436 B2 3/2004 Haines et al.
6,913,338 B2 7/2005 Rhoads et al.
6,938,971 B2 9/2005 Gom z et al.

FOREIGN PATENT DOCUMENTS

JP 2000015836 * 1/2000

* cited by examiner

*Primary Examiner*—Anh T. N. Vo

(57) ABSTRACT

A method for detecting a clog in a suspect portion of an ink conduit of an ink delivery system, includes the steps of pumping a slug of ink of a known volume into the ink conduit, attempting to pump the slug past the suspect portion, and detecting the presence of ink at a position beyond the suspect portion.

11 Claims, 4 Drawing Sheets

CLOG DETECTION AND CLEARING METHOD FOR INK DELIVERY SYSTEM

BACKGROUND

Inkjet printers frequently include an inkjet print head mounted on a carriage that is moved back and forth across print media, such as paper. As the print head is moved across the print media, a control system activates the print head to deposit or eject ink droplets onto the print media to form images and text.

The print head typically includes a fluid reservoir that is fluidically coupled to a substrate that includes ink passageways and is attached to the back of a nozzle layer containing one or more nozzles through which fluid is ejected. The substrate includes energy-generating elements that generate the force necessary for ejecting the fluid held in the reservoir. Two widely used energy-generating elements are thermal resistors and piezoelectric elements. The former rapidly heats a component in the fluid above its boiling point to cause ejection of a drop of the fluid. The latter utilizes a voltage pulse to generate a compressive force on the fluid resulting in ejection of an ink drop.

Ink is provided to the print head by a supply of ink that is either carried by the carriage or is mounted to the printing system and does not to move with the carriage. Where the ink supply is carried with the carriage, referred to as "on-board" or "on-axis" ink supply, the ink supply can be integral with the print head, such that the entire print head and ink supply is replaced when ink is exhausted.

Alternatively, printers have been developed having moving print heads that are connected to stationary ink supplies. This development is called "off-axis" printing and allows the ink supply to be replaced as it is consumed, without requiring the frequent replacement of the costly print head containing the fluid ejectors and nozzle system. Where the ink supply is separately replaceable, the ink supply is replaced when exhausted, and the print head need not be replaced until the end of print head life.

Naturally, it is desirable that the ink supply provide a reliable supply of ink to the inkjet print head. Clogs in ink conduits and passageways and/or changes in ink viscosity can impede this reliability. The ink itself is a mixture including pigments or dyes and other substances carried in a solvent base. The precise mixture of a given ink is carefully designed to provide certain desired qualities of appearance, durability, etc. after the ink is applied to a substrate and dries. The characteristics of the liquid ink are also important because they can affect the accuracy and efficiency of the ink delivery system. For example, the viscosity of a liquid ink is one parameter that can affect the pump metering accuracy of the delivery system, and thereby affect printing quality. Similarly, a high negative pressure on the inlet side of a peristaltic pump, e.g. caused by a clog, can also affect pump metering accuracy.

One challenge that must be dealt with in an ink delivery system is the potential for clogs in ink conduits and passageways, including the nozzles of the print head orifice plate. After an extended idle period, ink within an ink delivery system can gradually lose solvent, such that it either forms a solid obstruction, thereby preventing flow, or produces an increase in viscosity such that dynamic flow losses affect the pump metering accuracy. In a multi-color ink delivery system, such as a color printer that draws ink from multiple reservoirs of different colors, an obstruction or flow reduction associated with just one of the ink colors and one of the pens can significantly affect print quality, and/or result in substantial down time, lost productivity and expense while the problem is corrected.

Some proposed solutions for clearing clogs involve the activation of portions of existing pump recharge and purge cycles. However, because pump metering accuracy is likely affected while a flow obstruction is in place, portions of a pump cycle may be unsuccessful, potentially causing loss of backpressure in the print head or other problems.

BRIEF DESCRIPTION OF THE DRAWINGS

Various features and advantages of the invention will be apparent from the detailed description which follows, taken in conjunction with the accompanying drawings, which together illustrate, by way of example, features of the invention, and wherein.

DETAILED DESCRIPTION

Figure 1:
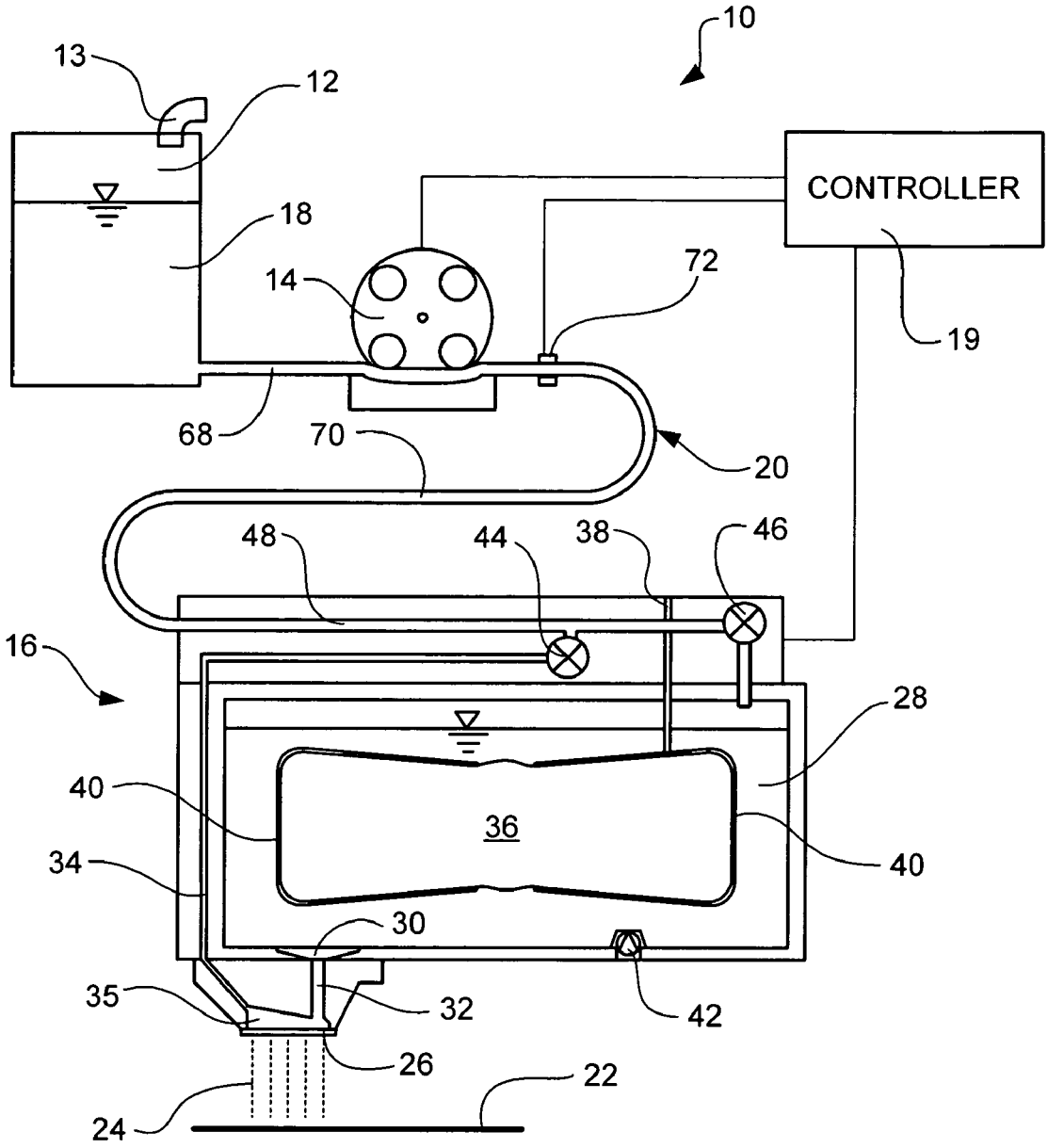
FIG. 1 is a schematic diagram showing the basic elements of one embodiment of an ink delivery system.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the invention as illustrated herein, which would occur to one skilled in the relevant art and having possession of this disclosure, are to be considered within the scope of the invention.

As noted above, after an extended idle period, ink within an ink delivery system, such as an ink jet printer, can lose sufficient solvent to either form a solid obstruction or to produce an increase in viscosity to a point where dynamic flow losses affect pump metering accuracy. The inventors have developed a method for detecting and clearing such obstructions in an ink delivery system. In one embodiment, the method for detecting a clog involves attempting to pump a slug of ink of a known volume past a suspected clog location in a conduit, and detecting whether the slug passes the suspected clog location. One embodiment of the method for clearing the clog involves running a pump algorithm to negatively pressurize the portion of the system most likely to clog in multiple stages. The method can clear the highly concentrated ink by dissolving it, and allow for unobstructed flow during subsequent recharge or purge cycles.

The method described herein involves pumping ink within an ink delivery system in order to detect and clear clogs in ink passageways. Provided in FIG. 1 is a semi-schematic diagram of one embodiment of an ink delivery system 10 in which this method can be practiced. The ink delivery system depicted in FIG. 1 is part of an inkjet printer device. The system generally includes a primary ink reservoir or ink supply 12 having a vent 13, a pump 14 (e.g. a reversible peristaltic pump), and a print head assembly (PHA) 16. Ink from the supply of ink 18 in the primary ink reservoir is pumped via the pump to the print head assembly through a fluid interconnect 20, which extends from the reservoir to the print head. A controller 19 is interconnected with the print head assembly and the pump, and is programmed to control their operation. The controller is also interconnected to an ink sensor 72, described in more detail below, and includes memory for storing data related the operation of all parts of the ink delivery system.

While the system shown in FIG. 1 depicts only one primary ink reservoir 12 connected to one print head assembly 16, it will be apparent that multiple ink supplies can be associated with a print head assembly having multiple print head ink reservoirs 28 and associated structure for ejecting multiple colors of ink. Color inkjet systems frequently include multiple ink supplies to contain each of the multiple ink colors that are used to produce color images. Some color inkjet printing systems use six colors of ink, for example, and therefore include six ink supplies, each ink supply being connected to a different print head ink reservoir like that shown in FIG. 1. The entire print head assembly is sometimes also referred to as a "pen".

In the embodiment shown in FIG. 1, the primary ink reservoir 12 and pump 14 are stationary, while the print head 16 is moveable, being mounted on a moving carriage (not shown) and traverses back and forth across a sheet of paper 22 or other print media to eject ink droplets 24 onto the media to produce characters or images in a manner well known. As discussed above, this type of system is referred to as having an "off-board" or "off-axis" ink supply. Because the primary ink reservoir is not part of the print head (and therefore does not need to move), off-board systems can generally hold a larger supply of ink than on-board systems, and they do not require replacement of the print head assembly or its removal when ink runs out.

On the other hand, "on-axis" or "on-board" systems are those in which the ink supply is included as part of the moveable inkjet print head assembly, as noted above. Many on-board systems do not include a pump for the ink supply, but rely upon gravity and capillary action to feed the ink to the print head. Because the present method involves pumping ink, the method disclosed herein applies to off-board systems generally, and also to on-board systems that include a pump.

Like inkjet printing systems generally, the inkjet print head assembly 16 includes an orifice plate 26 having a number of inkjet nozzles (not shown). The number and size of the nozzles depends upon the resolution of print images that the printer system is configured to produce (e.g. 300 dpi or 600 dpi). As 20, described above, disposed within each nozzle is an energy-generating element (not shown) that generates the force necessary for ejecting the ink droplets 24 from the nozzle toward the print media 22, in a manner well known in the art. The print head assembly supplies ink to the orifice plate from a print head ink reservoir 28. Ink in the print head ink reservoir flows downward through a standpipe filter 30, through the standpipe 32, to the plenum 35, a chamber from which ink is drawn into the individual nozzles. It should be borne in mind that the diagram of FIG. 1 is not to scale. Elements of the drawing, such as the print head, are shown greatly enlarged to show detail. For example, while the print head ink reservoir is shown quite large in the figure, it is frequently much smaller than the primary ink reservoir 12.

Within the print head reservoir is an accumulator 36. The accumulator is a flexible air bag that is fluidly connected, through an air conduit 38, to the atmosphere. A pair of springs 40 are disposed on the outside of the accumulator bag (though a single spring could also be provided for the same purpose) and tend to compress the bag to expel air from the bag to the atmosphere. The accumulator bag serves to regulate pressure within the print head reservoir 28. Ink in the print head reservoir is maintained at a slight vacuum pressure (e.g. −6 in. $H_2O$) relative to the atmosphere so that the ink does not dribble out of the print head nozzles in the orifice plate 26.

As ink or air are pumped into or out of the print head reservoir 28, the accumulator bag 36 automatically shrinks or expands as necessary to maintain this negative pressure. For example, as the pressure in the print head reservoir increases and approaches atmospheric pressure, the springs 40 associated with the accumulator bag will compress the bag so as to reduce the volume of the bag and thereby increase the available volume within the print head reservoir 28. This will tend to reduce the pressure in the print head ink reservoir.

Conversely, as the pressure in the reservoir 28 drops, atmospheric pressure in the accumulator bag 36 will tend to expand the accumulator bag until some maximum volume is reached at a maximum vacuum pressure level. The larger volume of the accumulator bag will displace more of the volume of the print head reservoir, thereby tending to increase the pressure in the print head reservoir by reducing the volume available for ink.

The print head reservoir 28 also includes, on its lower side, a bubbler valve 42. The bubbler valve functions as a pressure relief valve. The bubbler valve is a one-way air valve that allows atmospheric air to enter the print head reservoir when the pressure drops below some minimum threshold (e.g., −6 in. $H_2O$). The operation of this valve is discussed in more detail below.

The print head assembly 16 includes two other valves that relate to its operation in the method described herein. The first is a purge valve 44 (also called a recirculation valve), and the second is a body valve or inlet valve 46. Under normal operation of the printer system, the purge valves and body valves are closed, and ink is drawn from the print head ink reservoir for normal printing. The purge and body valves are only opened during recharge and purge cycles. A purge cycle is designed to remove or purge air from the region of the standpipe and plenum, below the print head ink reservoir. A recharge cycle is designed to remove air from the top of the print head ink reservoir, and also to replenish the ink supply in the print head reservoir. During recharge of the print head assembly, the purge valve is closed and the body valve is opened, and ink is pumped from the primary ink reservoir 12, through the fluid interconnect 20, and into a print head inlet passageway 48. With the purge valve closed and the body valve open, ink flows past the purge valve, through the body valve, and into the print head ink reservoir 28. The purge valve is only opened during a purge cycle. The recharge and purge cycles are described in more detail below.

Figure 2:
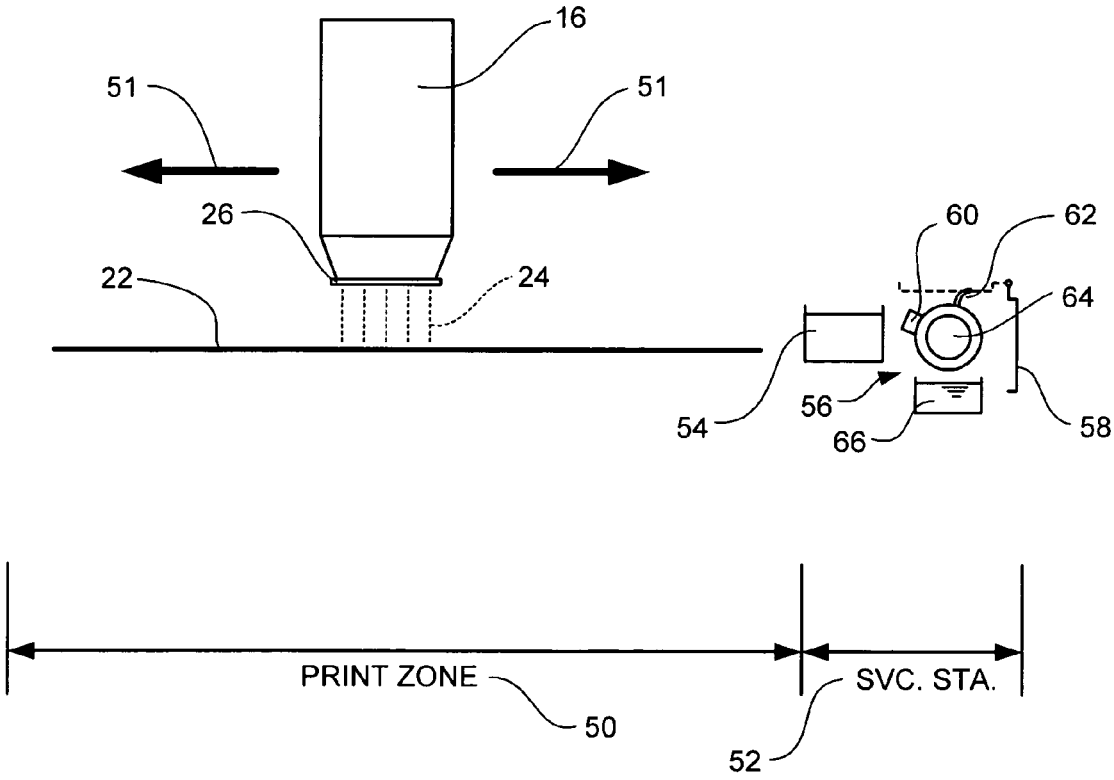
FIG. 2 is a schematic diagram showing an arrangement of a print head and print head service station.

The view of FIG. 1 provides a side view of the print head 16. In this view the motion of the print head during printing would be into or out of the plane of the page. The view of FIG. 2, on the other hand, is orthogonal to that of FIG. 1, showing the front of the print head. In FIG. 2 the side-to-side motion of the print head during printing is indicated by arrows 51. The path of the moving print head includes several regions, depicted in FIG. 2. The largest of these is the print zone 50, in which the print head moves during normal operation, ejecting ink drops 24 onto the print media 22 from the orifice plate 26.

When the print head 16 is not in operation, it is normally returned to a "home" or "service" station 52, where the print head can be routinely serviced. The service station can include a spittoon 54, a wiping system 56, and an orifice cap 58. The orifice cap is drawn over the orifice plate 26 to cover the nozzles when the print head is not active (or not being serviced) to cover and protect the nozzles. When ink is not being ejected from a given nozzle, a meniscus forms in the ink at the nozzle opening, preventing the ink from spilling out. However, if the print nozzles have been capped too long, they can eventually dry out, and thus burst the meniscus of the liquid ink. When the meniscus bursts, ink behind the meniscus can also dry out, and the ability of capillary action to draw ink from the snorkel and through the nozzle is hindered or entirely prevented. This can prevent ink from flowing through the very small inkjet nozzles, and thus prevents printing from affected nozzles.

In order to prevent drying out of the inkjet nozzles and to prevent the buildup of contaminants and ink on the pen orifice plate 26, the wiping system 56 is configured to clean the pen orifice plate on a routine basis. The wiping system includes a piece of porous material 60 that is saturated with priming fluid (i.e. ink solvent) and a wiper 62. The porous material and wiper are disposed on a rotating drum 64 that is positioned adjacent to a priming fluid reservoir 66. In the wiping operation, the drum rotates so that the porous material is first brought into contact with the priming fluid reservoir, to replenish its supply, and then rotates to cause the porous material to wipe across the orifice plate. This allows the priming fluid to dissolve any dried ink that covers or blocks the inkjet nozzles. Following application of the priming fluid, the drum rotates to cause the wiper to wipe off the priming fluid, dissolved ink, and other contaminants from the orifice plate, thereby leaving an orifice plate with fresh ink menisci in each orifice.

In the wiping procedure, the printer can undertake a routine service procedure wherein the pen first expels ink into the spittoon 54, which contains an absorbent material designed to absorb expelled ink, after which the wiping system 56 wipes the orifice plate with priming fluid, as described above, then the pen again expels ink into the spittoon. This procedure is sometimes called a spit-wipe-spit procedure. In some printers this service procedure is performed at the end of a print job based on certain criteria, such as the number of drops fired since the last spit-wipe-spit procedure, the time a pen has been uncapped, upon a user request, when power has first been applied to the printer, etc.

Referring back to FIG. 1, the fluid interconnect 20 includes several distinct portions. The portion of the fluid interconnect between the pump 14 and the primary ink reservoir 12 is referred to as the static tube 68 because it does not move. The bulk of the fluid interconnect 20 between the pump 14 and the print head 16 is referred to as the dynamic tube 70 because it is required to move with the moving print head. Because the dynamic tube must move essentially constantly during operation of the printer system, it is typically made of a more flexible (and sometimes more permeable) material than other ink conduits in the printer system.

An ink sensor 72 is positioned near the beginning of the dynamic tube 70. The ink sensor is configured to detect the presence of ink in the fluid interconnect 20 at the sensor location. A variety of types of sensors can be used to detect the presence of ink. In one embodiment, the ink sensor is a conductive sensor, and detects conductance across the fluid interconnect tube. The ink sensor measures conductance between two electrodes. Because the ink 18 is conductive, a current is passed when ink is present. However, when ink is not present, or what is present is froth (air bubbles in ink) the current passed between the electrodes drops because the conductance of froth or air is smaller than that of the ink. This condition indicates no ink in the conduit. When the primary ink reservoir 12 runs out of ink and the pump 14 begins to pump froth or air from that reservoir, the ink sensor will indicate such, providing an out-of-ink signal.

As noted above, air can accumulate in the print head assembly 16 in the region of the plenum 35 and in the top of the print head ink reservoir 28. In order to remove this air and replenish the ink in the print head ink reservoir, the printer system is configured to periodically perform a purge cycle and a recharge cycle. As noted above, the pump 14 is a reversible pump. In describing the recharge and purge cycles and the clog detection and clearing method disclosed herein, the pump will be referred to as "pushing" or pumping forward when pumping fluid toward the print head assembly 16, and as "pulling" or pumping in reverse when pumping fluid away from the print head assembly.

In the print head system of FIG. 1, a purge cycle can be routinely performed to remove air that has accumulated below the standpipe 32, in the region of the plenum 35 and snorkel 34. In the purge process, the body valves 46 are first closed, and the purge valves 44 are opened. The pump 14 then pulls in order to draw a certain volume from the snorkel 34 and into the fluid interconnect 20. This volume will include the air that was formerly in the snorkel. Once the volume removed from the snorkel is past the purge valves, the purge valves are then closed, and the body valves 46 are opened. The pump then pumps forward to push this mixture of air and ink into the print head ink reservoir 28 through the body valve.

It will be apparent that this purge operation will cause ink in the print head ink reservoir 28 to initially flow down through the standpipe 32 to fill the removed volume in the plenum 35. As ink is drawn from the print head ink reservoir, the pressure in the reservoir will drop, causing the accumulator bag 36 to expand. Then, when the ink and air from the snorkel are pumped back through the body valves 46 into the print head ink reservoir, this will increase the pressure in the reservoir, causing the accumulator bag to shrink again.

At this point, there is now more air and less ink than are desired in the print head ink reservoir 28, and with the accumulator bag 36 relatively deflated, the pressure is higher than desired.

The recharge cycle is designed to remove air from the top of the print head ink reservoir, and thereby reduce the pressure in the print head ink reservoir and reinflate the accumulator bag, and also to pump ink from the primary ink reservoir into the print head ink reservoir. Ordinarily, recharge is triggered when the system determines that the ink supply in the print head ink reservoir is low. This determination can be based upon a drop count trigger that estimates the volume in the print head ink reservoir based upon a count of ink drops that have been ejected from the print head since the last recharge.

In the recharge process, the body valves 46 are opened, and, with the pump 14 in reverse, a small volume of fluid is pulled out of the top of the print head ink reservoir. This volume is likely to be entirely air though it may also include some froth (ink air bubbles). When the pressure in the print head ink reservoir has dropped to the design level, the accumulator bag 36 will be fully inflated, and air bubbles can begin to enter the ink reservoir through the bubbler valve 42. These bubbles will naturally float to the top of the print head ink reservoir, and will thus also be withdrawn into the print head inlet passageway 48 and the fluid interconnect 20.

After this first small volume has been pulled out of the print head ink reservoir, the pump then reverts to the forward direction and pumps the volume just extracted back into the ink reservoir, along with a following volume of ink to replenish the print head ink supply. The extraction of the initial volume is to ensure that the vacuum pressure in the print head ink reservoir is at the design level, so that the subsequent forward pumping will not raise the pressure to atmospheric pressure and allow ink to leak out of the print head nozzles.

As ink is pumped into the reservoir, the accumulator bag will shrink because the pressure in the reservoir will increase.

Once the desired new volume of ink has been pumped into the print head ink reservoir, the pump then stops and reverses again, to pull a small volume back out of the top of the print head ink reservoir. The air pumped back into the print head ink reservoir during recharge will naturally remain at the top. Accordingly, the ink just pumped into that reservoir will remain, allowing the system to again draw the air out of the print head ink reservoir, thus restoring the desired vacuum pressure and reinflating the accumulator bag. At this point, the recharge cycle is complete.

As ink is subsequently withdrawn from the print head ink reservoir 12 and pumped to the print head in the normal printing process, the recharge cycle is periodically repeated in order to replenish the ink volume in the print head ink reservoir 28. This allows air from the print head ink reservoir to be repeatedly drawn into the fluid interconnect, then back into the print head ink reservoir along with more ink, then back into the fluid interconnect again, so that ink is resupplied while always maintaining the desired negative pressure.

Because the dynamic tube 70 is typically made of a more flexible and/or more permeable material, the dynamic tube presents a location in the ink delivery system where ink is more likely to solidify and produce a clog. Additionally, through the normal recharge and purge cycles, air is repeatedly removed from the print head 16 and placed in the fluid interconnect 20, particularly in the dynamic tube 70. This condition makes clogs more likely to form in the dynamic tube.

If there is a clog in the system, however, even in the dynamic tube 70, it is possible that ink may still be present in the conduit adjacent to the ink sensor 72, even throughout the purge and recharge cycles. Consequently, the normal purge and recharge routines may not be sufficient to detect or correct clogs in the dynamic tube.

Figure 3:
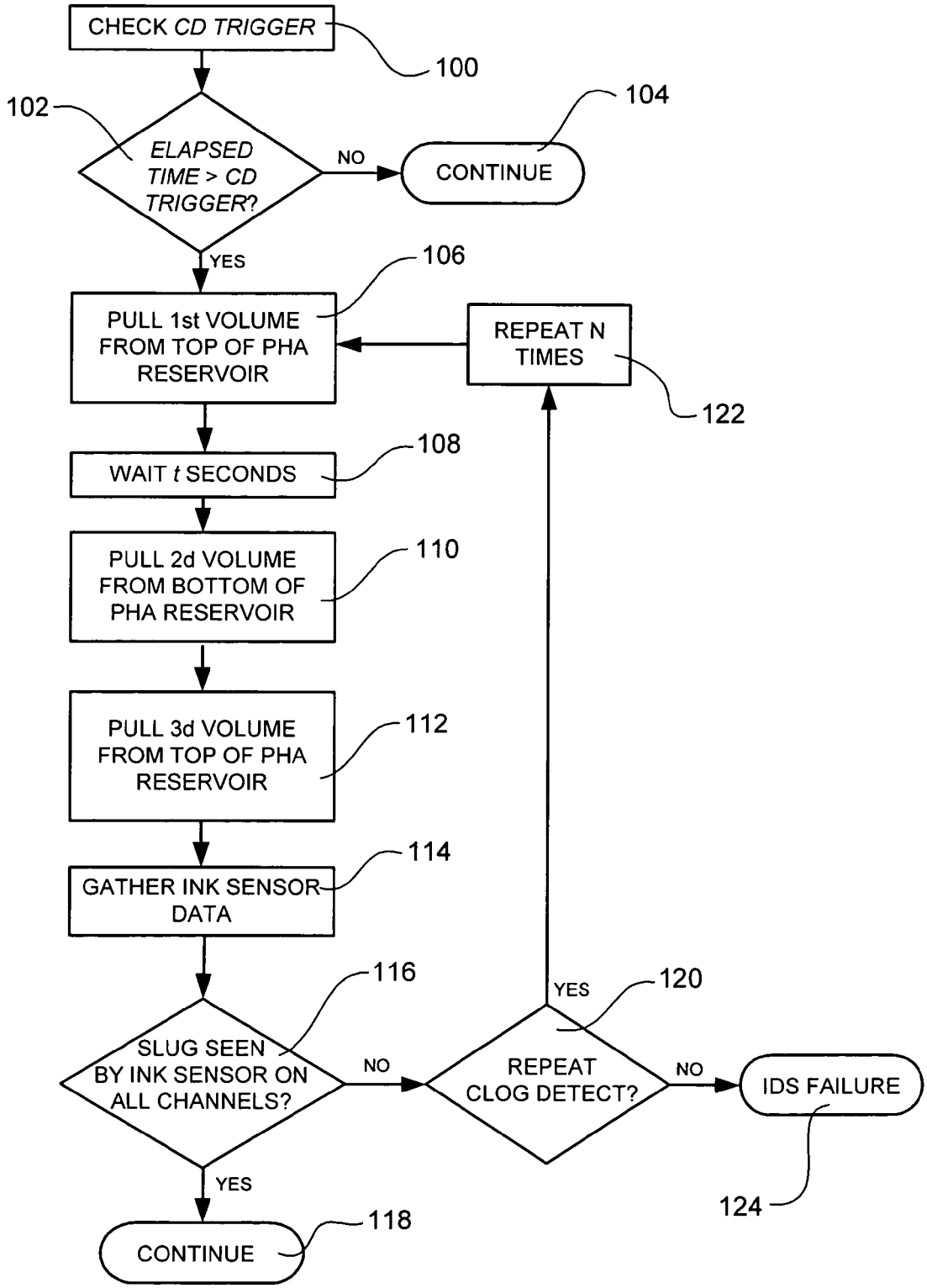
FIG. 3 is flow chart showing one embodiment of a method for detecting and clearing clogs in an ink delivery system.

Advantageously, the inventors have developed a method whereby a clog can be detected in the dynamic tube, and can be cleared in many instances, thus reducing the need for servicing of the printing system. Provided in FIG. 3 is a flow chart showing the basic steps in one embodiment of a method or routine for detecting and clearing clogs in an ink delivery system, such as the system shown in FIG. 1.

The first step in the clog detect routine is to check the Clog Detect ("CD") Trigger, step 100. The name CD Trigger is simply an arbitrarily chosen name for a time length variable programmed into the printer control software. It will be apparent that any name or designation for this variable could be chosen. This variable represents a time interval, and the software can be programmed to check this trigger when the printer is powered-up, and/or before each print job ("pre-job"), or at any other desired time. It is believed that 90 days is a likely time interval value for the CD Trigger, though any other desired time interval can be used.

After checking the CD Trigger, the system next considers, at step 102, whether the Elapsed Time since the last purge or recharge routine is greater than the CD Trigger. Elapsed Time is simply an arbitrarily chosen name for a variable stored in memory that represents the time that has passed since the last performance of the purge or recharge routine. Any name or designation for this variable could be chosen. If the Elapsed Time since the last clog detect does not exceed the CD Trigger interval, the printer system continues as normal (step 104). However, if the time interval has been exceeded, the system proceeds with the clog detect and clearing routine.

The first step in actually detecting and clearing a clog is to pull a volume from the top of the print head reservoir (step 106). That is, the pump (14 in FIG. 1) is run in reverse so as to pull a volume of ink and/or air from the top of the print head ink reservoir (28 in FIG. 1) into the fluid interconnect (20 in FIG. 1). Once this volume has been pulled into the fluid interconnect, the pump stops and the routine waits for a time interval t (step 108) before continuing. This time interval provides an opportunity for any clog that may exist in the fluid interconnect, especially the dynamic tube (70 in FIG. 1) portion of the fluid interconnect to be dissolved. Since the ink in the inkjet printing system consists of dyes in a solvent base, drawing liquid ink into the fluid interconnect and allowing that ink to remain in contact with a clog for a period of time can allow the clog to dissolve. Then, upon further pumping, the clog can then be cleared.

After the time interval has passed, the system then draws a second volume from the bottom of the print head reservoir (step 110). Viewing FIG. 1, this volume would be drawn from the snorkel region 34 of the print head. This is done to ensure that this second volume is substantially entirely of ink, and contains little or no air. The first volume drawn from the top of the print head ink reservoir is likely to contain air. In order to allow detection by the ink sensor (72 in FIG. 1), it is desirable to have a slug of a known volume of ink that can be drawn back to the position of the sensor. That is the purpose of this second volume.

As the routine continues, the system draws a third volume from the top of the print head reservoir (step 112), for the purpose of transporting the second volume back to the position of the ink sensor (72 in FIG. 1). As with the first volume, this volume may contain ink and/or air, though it is more likely to be air because the ink volume and pressure in the print head ink reservoir are both low at this point. With low volume the ink level is not likely to be near the inlet of the body valve, and with low pressure the system will simply draw air through the bubbler valve, this air bubbling up through the ink and immediately passing through the body valve.

The system then gathers data from the ink sensor (step 114), which means that the system determines, using the ink sensor, whether ink is present in the fluid interconnect at the position of the ink sensor. In a system with multiple colors of ink and therefore multiple fluid interconnects, there will be multiple ink sensors, a signal from each being transmitted back to the printer controller on a separate channel. The system then analyzes whether a slug of ink (the second volume) has been detected on all channels (step 116), that is, in each fluid interconnect. If so, this indicates that no clogs are present, and the ink delivery system is ready to continue operating normally (step 118).

If, however, the second ink slug was not detected at the ink sensor in step 116, this indicates the presence of a clog. At this point, the system can consider whether to repeat the clog detection and clearing routine (step 120). For example, upon an initial detection of a clog, the system can be configured to repeat the clog detection and clearing routine up to N times (step 122), returning to step 106 to begin the sequence of pulling each volume from the print head. This allows for the repeat of the routine in case the initial results of the test were faulty in some way, or to allow the additional dissolving time interval (step 108) to potentially dissolve a clog that is present. If the routine is not to be repeated, or has been repeated N times and still indicates a clog, an ink delivery system (IDS) failure or error message is sent to the printer controller (step 124). The failure or error message can indicate that the print head requires servicing, and the printer controller can switch to a mode that prevents continued use until the servicing is performed.

Figure 4:
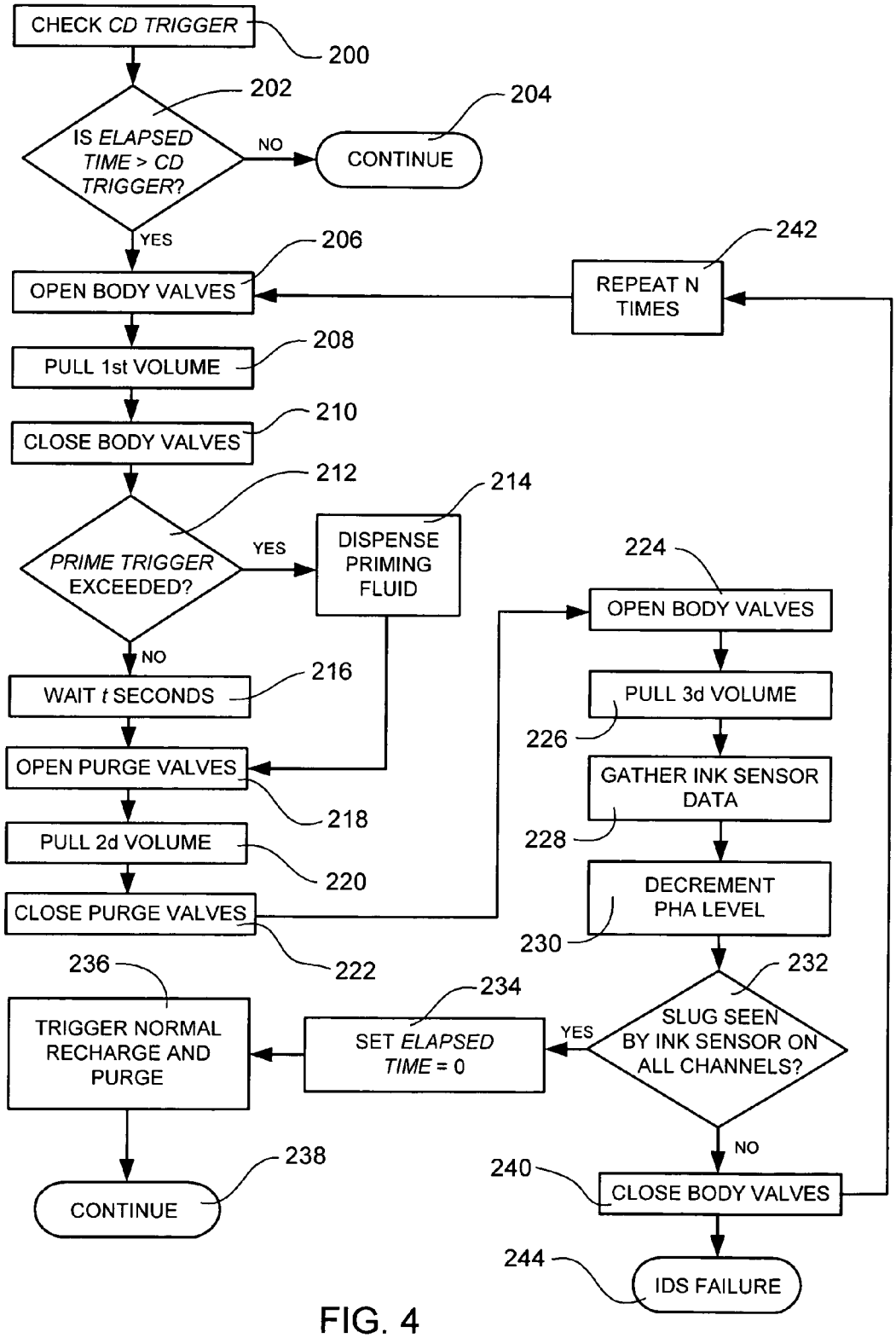
FIG. 4 is a flow chart showing a more detailed embodiment of a method for detecting and clearing clogs in an ink delivery system.

Shown in FIG. 4 is a more detailed flow chart showing the steps in one embodiment of the method for detecting and clearing clogs. As with the flowchart in FIG. 3, the first steps in the more detailed clog detect routine are to check the Clog Detect ("CD") Trigger (step 200), then determine whether the Elapsed Time since the last performance of the purge or recharge routines is greater than the CD Trigger (step 202). If not, the printer system continues as normal (step 204). However, if the time interval has been exceeded, the system proceeds with the clog detect and clearing routine.

As noted above, the first step in actually detecting and clearing a clog is to pull a first volume from the top of the print head reservoir. Drawing this volume first requires the body valves (46 in FIG. 1) to be opened (step 206), then running the pump in reverse to pull the first volume (step 208). After this volume has been pulled into the fluid interconnect (20 in FIG. 1) the body valves are then closed (step 210).

At this point in the routine, it is possible to run a wiping operation. The system first checks whether the Prime Trigger has been exceeded (step 212). The Prime Trigger is a variable that relates to the time between the application of priming fluid to the orifice plate. If the print nozzles have been capped too long, they can dry out, and the meniscus will burst. The priming fluid trigger is a time-based trigger for applying the priming fluid to replenish the meniscus in each nozzle. This prevents the drawing of air through the nozzles upon pumping out of the snorkel area, and can be a desirable prelude to pulling the second volume from below the standpipe. While wiping of the orifice plate is routinely performed as a printer is used, it will not happen during a long period of non-use. The priming fluid trigger can be 90 days, for example, though other time lengths can also be used. If the Prime Trigger has been exceeded, a wiping routine is instituted (step 214) using the wiping system apparatus (56 in FIG. 1) to prime and wipe the orifice plate.

The wiping routine takes a certain time to perform. Thus, if wiping is performed during the clog detect routine, this automatically provides a time interval during which the first pump volume can dissolve any clog that might be present in the fluid interconnect. However, if the prime routine is not performed (i.e. the Prime Trigger was not exceeded as measured in step 212), the routine waits for a time interval t (step 216) before continuing to provide a time interval for any clog that may exist in the fluid interconnect to be dissolved.

After the time interval has passed, the system then opens the purge valves (44 in FIG. 1) at step 218, then pulls the second volume from the bottom of the print head (step 220) in the same manner discussed above with respect to FIG. 3. Again, it is desirable that this second volume be substantially entirely of ink, and contain little or no air so that it can be detected by the ink sensor (72 in FIG. 1).

As the routine continues, the system then closes the purge valves (step 222), then reopens the body valves (step 224) and draws the third volume from the top of the print head reservoir (step 226). Drawing this third volume transports the second volume to the position of the ink sensor (72 in FIG. 1), allowing the sensor to detect the presence of ink. The system then gathers data from the ink sensors on each channel (step 228), which allows it to determine whether ink is present in the fluid interconnect at the position of the ink sensor on each channel (step 232). If a slug of ink is detected on all channels, this indicates that no clogs are present, and the ink delivery system is ready to continue operating normally. The system first resets the Elapsed Time variable equal to zero (step 234), so that the clog detect routine will not be performed again until the CD Trigger is exceeded, and then triggers a normal purge and recharge sequence as described above (step 236) so that all air bubbles are removed from below the standpipe, and the print head ink reservoir and accumulator bag are filled as needed for normal operation. The system then continues operating normally (step 238).

An additional step that takes place after the ink sensor data is gathered and before continuing is to decrement the PHA Level (step 230). The PHA level is a variable that indicates the ink volume stored in the print head ink reservoir. During each step in the clog detection and clearing routine, and during the normal recharge and purge routines, each pull of fluid from the print head is of a known volume because the pumping characteristics of the peristaltic pump (14 in FIG. 1) are known. Thus, with each step, the system can very accurately pump or pull a desired volume to or from a given chamber. Likewise, because the size of the fluid interconnect and other ink passageways is known, the system can very accurately determine what volume to draw in order to transport ink or air to a given location, such as for detection by the ink sensor. Furthermore, because the pump characteristics are known, the time interval between different detection signals from the ink sensor also indicates the volume of air or ink that has been pumped in any given phase. Consequently, after the clog detect and clearing routine has run, a certain known cumulative volume will have been removed from the print head. Thus the PHA level will have been reduced by that amount, and the routine thus decrements the PHA level value that is stored in memory accordingly.

If the second ink slug was not detected at the ink sensor in step 232, this probably indicates the presence of a clog. At this point, the system closes the body valves (step 240), and if programmed to do so, can repeat the clog detection and clearing routine (step 242) up to N times, as discussed above with respect to FIG. 3. If the routine is not to be repeated, or has been repeated N times and still indicates a clog, an IDS failure message is sent to the printer controller (step 244).

One advantageous feature of the method is that it relies entirely on pulling volumes from the print head assembly, and therefore does not present the possibility of dissipating the vacuum pressure in the print head ink reservoir and possibly allowing ink to leak through the nozzles. Because the negative pressure is maintained, there is no leakage through the print nozzles. At the same time, there is no danger of creating excessive negative pressure because the bubbler valve (42 in FIG. 1) will allow the entry of air bubbles from the atmosphere if the pressure in the print head ink reservoir drops below a minimum pressure threshold. The method also maintains a negative pressure in the dynamic tube so as to reduce the danger of positive pressure which could blow off fittings or other associated parts and also create an ink leak situation.

The method thus allows the pump to run solely for the purpose of detecting and clearing clogs within the ink delivery system. If pump metering accuracy is reduced during this cycle, the impact will be minimal. However, because this clog detect and clearing cycle can be effective at removing flow obstructions and restoring pump metering accuracy, the subsequent recharge and/or purge cycles will be more effective. Another advantage of this method is that fewer recharge and purge cycles are affected by ink clogs in the ink delivery system.

It is to be understood that the above-referenced arrangements are illustrative of the application of the principles of the present invention. It will be apparent to those of ordinary skill in the art that numerous modifications can be made without departing from the principles and concepts of the invention as set forth in the claims.

What is claimed is:

1. A clog detection and clearing method for an ink delivery system including a stationary primary ink supply, a moveable print head having an ink reservoir, a dynamic tube fluidly interconnecting the primary ink supply and the ink reservoir, and a reversible pump disposed to pump ink within the dynamic tube, comprising the steps of:

a) pulling a volume of ink from the print head ink reservoir into the dynamic tube;

b) allowing the volume of ink to remain in the dynamic tube for a time interval so as to potentially dissolve a clog at a suspected clog location therein;

c) pulling the volume of ink toward an ink sensor proximal of the suspected clog location; and d) sensing with the ink sensor whether the volume of ink has reached the ink sensor, and further comprising the steps of providing to a controller of the ink delivery system an indication representing a total volume of ink withdrawn from the printhead, and decrementing an ink level variable stored in memory in the controller.

2. A clog detection and clearing method in accordance with claim 1, further comprising repeating steps (a) through (d) if ink is not initially sensed in step (d).

3. A clog detection and clearing method in accordance with claim 1, further comprising the step of triggering a routine purge and recharge routine following detection of ink at the ink sensor.

4. A clog detection and clearing method for an ink delivery system including a stationary primary ink supply, a moveable print head having an ink reservoir, a dynamic tube fluidly interconnecting the primary ink supply and the ink reservoir, and a reversible pump disposed to pump ink within the dynamic tube, comprising the steps of:

a) pulling a volume of ink from the print head ink reservoir into the dynamic tube;

b) allowing the volume of ink to remain in the dynamic tube for a time interval so as to potentially dissolve a clog at a suspected clog location therein;

c) pulling the volume of ink toward an ink sensor proximal of the suspected clog location; and d) sensing with the ink sensor whether the volume of ink has reached the ink sensor, and further comprising the step of determining whether an elapsed time since a most recent previous priming of an inkjet orifice plate of the ink delivery system exceeds a predetermined prime trigger value, and, if so, priming the inkjet orifice plate.

5. A clog detection and clearing method in accordance with claim 4, further comprising repeating steps (a) through (d) if ink is not initially sensed in step (d).

6. A clog detection and clearing method in accordance with claim 4, further comprising the step of triggering a routine purge and recharge routine following detection of ink at the ink sensor.

7. A clog detection and clearing method for an inkjet printer system including a stationary primary ink supply, a moveable print head having an ink reservoir, a dynamic tube fluidly interconnecting the primary ink supply and the ink reservoir, and a reversible pump disposed to pump ink within the dynamic tube, comprising the steps of:

a) determining whether an elapsed time since a most recent previous purge and recharge cycle of the printer system has exceeded a clog detect trigger;

b) pulling a first volume of fluid from a top region of the ink reservoir;

c) pulling a volume of ink from a bottom region of the ink reservoir;

d) pulling a second volume of fluid from the top region of the print head ink reservoir;

e) pulling the first volume of fluid, followed by the volume of ink and the second volume of fluid into the dynamic tube to a suspected clog location in the dynamic tube;

f) allowing the volume of ink to remain in the dynamic tube for a time interval so as to potentially dissolve a clog at the suspected clog location;

g) pulling the first volume of fluid, followed by the volume of ink and the second volume of fluid toward an ink sensor proximal of the suspected clog location so that the volume of ink can arrive at the ink sensor; and h) sensing with the ink sensor whether the volume of ink has reached the ink sensor.

8. A clog detection and clearing method in accordance with claim 7, further comprising repeating steps (b) through (g) up to a predetermined maximum number of times, so long as ink is not sensed in step (g).

9. A clog detection and clearing method in accordance with claim 8, further comprising the step of providing to a controller of the inkjet printer system a failure indication if ink is not sensed in step (g) after repeating steps (b) through (g) the predetermined maximum number of times.

10. A clog detection and clearing method in accordance with claim 7, further comprising the steps of:

i) determining whether an elapsed time since a most recent previous priming of an inkjet orifice plate of the ink delivery system exceeds a predetermined prime trigger value; and j) priming the inkjet orifice plate during the time interval of step (f) if the prime trigger value has been exceeded.

11. A clog detection and clearing method in accordance with claim 7, further comprising the steps of:

k) providing to a controller of the inkjet printer system an indication representing a total volume of ink withdrawn from the printhead;

l) decrementing an ink level variable stored in memory in the controller; and m) triggering a routine purge and recharge routine following detection of ink at the ink sensor.

* * * * *